US009528504B2

(12) United States Patent
Shibata et al.

(10) Patent No.: US 9,528,504 B2
(45) Date of Patent: Dec. 27, 2016

(54) SWASH PLATE

(71) Applicant: TAIHO KOGYO Co., Ltd., Toyota-shi, Aichi (JP)

(72) Inventors: Masato Shibata, Toyota (JP); Kyohei Yamane, Toyota (JP); Shingo Goto, Toyota (JP)

(73) Assignee: TAIHO KOGYO CO., LTD., Toyota-Shi, Aichi (JP)

( * ) Notice: Subject to any disclaimer, the term of this patent is extended or adjusted under 35 U.S.C. 154(b) by 264 days.

(21) Appl. No.: 14/387,867

(22) PCT Filed: Mar. 25, 2013

(86) PCT No.: PCT/JP2013/058567
§ 371 (c)(1),
(2) Date: Sep. 25, 2014

(87) PCT Pub. No.: WO2013/146677
PCT Pub. Date: Oct. 3, 2013

(65) Prior Publication Data

US 2015/0033940 A1 Feb. 5, 2015

(30) Foreign Application Priority Data

Mar. 26, 2012 (JP) ..... 2012-69610

(51) Int. Cl.
*F04B 27/08* (2006.01)

(52) U.S. Cl.
CPC ..... *F04B 27/0873* (2013.01); *F04B 27/086* (2013.01); *F04B 27/0886* (2013.01);
(Continued)

(58) Field of Classification Search
CPC .... F04B 27/1036; F04B 27/109; F01B 3/0073
(Continued)

(56) References Cited

U.S. PATENT DOCUMENTS 6,584,886 B2 7/2003 Sugiura et al.
7,156,014 B2 1/2007 Sugioka et al.
(Continued)

FOREIGN PATENT DOCUMENTS

EP 0926340 A2 6/1999
EP 2042731 A2 9/2009
(Continued)

OTHER PUBLICATIONS

Extended European Search Report for corresponding European patent application No. 13768133.4-1608/2832995 PCT/JP2013/058567; Dated: Mar. 1, 2016.

*Primary Examiner* — Thomas E Lazo
(74) *Attorney, Agent, or Firm* — Cantor Colburn LLP

(57) ABSTRACT

The outer periphery of the outer part of a substrate is a chamfer, and the outer part of the substrate is covered by a resin film layer. The thickness of the resin film layer at the chamfer is thicker than the locations radially further inwards from said chamfer. The surface of the resin film layer on the outer peripheral edge of the outer part is coplanar with the surface of the resin film layer further inwards. These locations act as the sliding surface (the surface of the swash plate) that slides on a shoe, and compared with conventional techniques, because the resin film layer in the outer peripheral edge is thick, attrition of the portion being pressed against the shoe is suppressed. For that reason, the outer peripheral edge of the substrate and the vicinity thereof are prevented from being exposed, and seizure of the swash plate can be prevented.

3 Claims, 3 Drawing Sheets

(52) U.S. Cl.
CPC ..... *F04B 27/0891* (2013.01); *F05C 2251/14* (2013.01); *F05C 2253/12* (2013.01); *F05C 2253/20* (2013.01)

(58) Field of Classification Search
USPC ..... 92/12.2, 71, 155
See application file for complete search history.

(56) References Cited

U.S. PATENT DOCUMENTS

| | | | | |
|---|---|---|---|---|
| 7,241,722 | B2 | 7/2007 | Murase et al. | |
| 7,377,754 | B2 | 5/2008 | Saiki et al. | |
| 2002/0025259 | A1 | 2/2002 | Sugiura et al. | |
| 2004/0052649 | A1 | 3/2004 | Murase et al. | |
| 2004/0261611 | A1 | 12/2004 | Sugioka et al. | |
| 2005/0135954 | A1 | 6/2005 | Saiki et al. | |
| 2009/0097990 | A1 * | 4/2009 | Kubo ..... | F04B 27/1054 417/269 |

FOREIGN PATENT DOCUMENTS

| | | | |
|---|---|---|---|
| JP | 2001349276 | A | 12/2001 |
| JP | 2002021719 | A | 1/2002 |
| JP | 2002-39062 | A | 2/2002 |
| JP | 2004-84656 | A | 3/2004 |
| JP | 2004-316499 | A | 11/2004 |
| JP | 2005-30376 | A | 2/2005 |
| JP | 2006266102 | A | 10/2006 |
| JP | 2009-97492 | A | 5/2009 |

* cited by examiner

Conventional product (T2>T1)

SWASH PLATE

CROSS REFERENCE TO RELATED APPLICATIONS

This is the U.S. national stage of application No. PCT/JP2013/58567, filed on Mar. 25, 2013. Priority under 35 U.S.C. §119(a) and 35 U.S.C. §365(b) is claimed from Japanese Application No. 2012069610, filed Mar. 26, 2012, the disclosure of which is also incorporated herein by reference.

TECHNICAL FIELD

The present invention is related to a swash plate, in particular to a swash plate of a swash plate type compressor arranged with a resin film layer serving as a sliding surface.

BACKGROUND ART

Conventionally, forming a resin film layer on a surface of a substrate and using the resin film layer as a sliding surface has been proposed as a swash plate of a swash plate type compressor (for example Patent Document 1 to Patent Document 3). In such a conventional swash plate, a swash plate rotated by rotary shaft slides with a shoe serving as a mating member when the swash plate rotates, lubricating oil is supplied from the inner peripheral side of the swash plate and the sliding parts of both members become lubricated.

CITATION LIST

Patent Literature

PTL 1: Japanese Laid Open Patent Publication No. 2004-84656

PTL 2: Japanese Laid Open Patent Publication No. 2004-316499

PTL 3: Japanese Laid Open Patent Publication No. 2005-30376

SUMMARY OF THE INVENTION

As is shown in FIG. 4 and FIG. 5, in a conventional swash plate 2, an outer peripheral part of an outer part 11B of a substrate 11 serves as a chamfered part 11C which is chamfered to 45 degrees or chamfered in an arc shape. In addition, a resin film layer 12 is formed to cover most of the area of an outer part 11B including an outer peripheral edge 11B' of the outer part 11B and the chamfered part 11C. In addition, in the conventional swash plate 2, as is shown enlarged in FIG. 5, the chamfered part 11C and outer peripheral edge 11B' and the resin film layer 12 of adjacent inner sections of both are formed to be thinner than other sections along a cross-sectional shape of the chamfered part 11C and outer peripheral edge 11B'. In the conventional swash plate 2, a surface 2A of the swash plate 2, that is, a flat surface in the resin film layer 12, serves as a sliding surface which slides with an end surface 4B of a shoe 4. In addition, when the outer peripheral edge of the sliding surface, that is, and outer diameter of the outer peripheral edge 2A' of the flat sections of the surface of the resin film layer 12 is given as D, and the outer diameter of the outer peripheral edge 11B' of the outer part 11B of the substrate 11 is given as d, D<d in the swash plate 2. That is, in conventional products, the outer peripheral edge of a sliding surface which was formerly located slightly radially inwardly than the outer peripheral edge 11B' of the outer part 11B. In addition, when the thickness of the resin film layer 12 in the outer peripheral edge 11B' of the sliding surface 11B of the substrate 11 described above is given as T1, and the thickness of the resin film layer 12 in the outer peripheral edge 2A' of the sliding surface is give as T2, T2>T1. More specifically, while T1 is set to 1~40 μm, T2 was set to 2~50 μm. As a result, as is shown in FIG. 5, in the conventional swash plate 2, the chamfered part 11C and outer peripheral edge 11B' and the resin film layer 12 of adjacent inner sections are in a state a little retracted than the resin film layer 12 of other areas which serve as a sliding surface. Furthermore, in FIG. 4 and FIG. 5 which show conventional products, the same numerals denoted to parts are attached to parts corresponding to the embodiments of the present invention described below. The swash plate 2 is mounted tilted with respect to an axis of a rotary shaft 1, rotates together with the rotary shaft 1 in this state, and together the surface 2A which is a surface of the swash plate 2 (surface of the resin film layer 12) slides with the shoe 4. At this time, because the swash plate 2 rotates tilted, the shoe 4 which slides above the swash plate 2 slides depicting an oval shaped movement locus above the surface 2A (surface of the resin film layer 12) of the swash plate 2. In addition, when a piston of a swash plate type compressor is located at the top dead center or top bottom center, as is shown in FIG. 4, the shoe 4 is located above the resin film layer 12 in the chamfered part 11C the outer peripheral edge 11B' slightly titled. In this state, because the outer peripheral edge 11B' which becomes thinner and the resin film layer 12 in this vicinity are strongly pressed by the end surface 4B of the shoe 4, the outer peripheral edge 11B' and resin film layer 12 in this vicinity become worn, and the outer peripheral edge 11B' of the outer part 11B and the resin film layer 12 in this vicinity are sometimes exposed. When the substrate 11 is exposed in this way, there is a problem whereby the end surface 4B of the shoe 4 slides with the exposed sections of the substrate 11 and seizure is generated.

Means for Solving the Problem

In view of the circumstances described above, the present invention is a swash plate provided with a substrate formed in a disc shape and with a chamfered part on an outer peripheral edge of an outer part, and a resin film layer arranged to cover an outer part of the substrate and formed beyond an outer peripheral edge of an outer part serving as the chamfered part to cover up to the chamfered part, a flat surface of the resin film layer serving as a sliding surface sliding with a shoe, wherein the resin film layer in the chamfered part is thicker than the chamfered part and thicker than the resin film layer in a radial inner direction side, the outer peripheral edge of the flat surface of the resin film layer serving as a sliding surface is located above the chamfered part serving as a radial outer direction than an outer peripheral edge of the outer part of the substrate, and when a thickness of the resin film layer at the outer peripheral edge of the flat surface of the resin film layer is given as T2 and a thickness of the resin film layer at the outer peripheral edge on the outer part of the substrate is given as T1, the thickness T2 is set larger than the thickness T1.

Effects of the Invention

According to this type of structure, the resin film layer in the chamfered part described above becomes thicker than the resin film layer on the inner side in a radial direction than the chamfered part, and the thickness T2 described above is set larger than the thickness T1. As a result, when a sliding surface of the swash plate slides with the shoe, even if the shoe is strongly pressed to the resin film layer in the outer peripheral edge of the outer part described above, it is possible to suppress wear of the resin film layer at this position. Consequently, because it is possible to prevent the outer peripheral edge of the outer part of the substrate and that vicinity from being exposed, it is possible to provide a swash plate in which seizure is less likely to occur when compared with the prior art described above.

DESCRIPTION OF EMBODIMENTS

Figure 1:
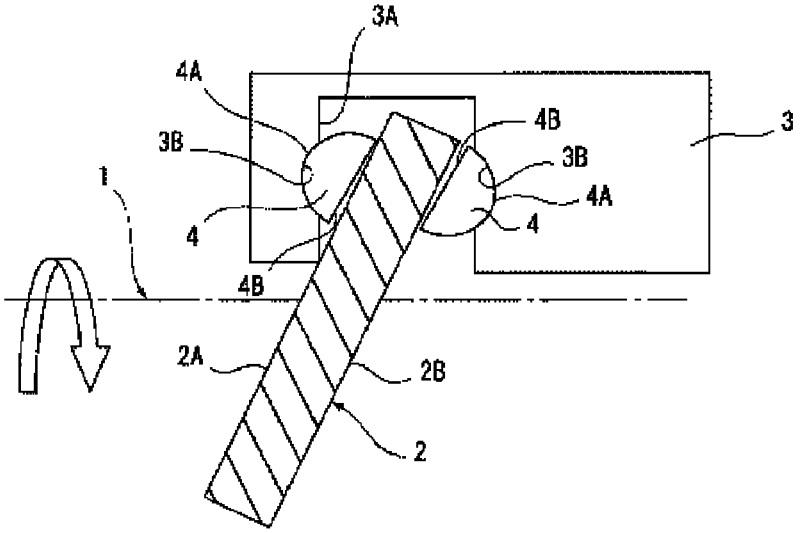
FIG. 1 is a front view of the main parts showing one embodiment of the present invention.

When explaining the present invention with reference to the illustrated embodiments below, FIG. 1 shows the main parts of a swash plate type compressor. The swash plate type compressor is arranged with a disc-shaped swash plate 2 attached to be tilted to an outer peripheral part of a rotary shaft 1, a plurality of pistons 3 arranged along the rotary shaft 1 and wrap the outer peripheral part of the swash plate 2 by a notch part 3A of one end, and a plurality of hemispherical shoes 4 arranged between a pair of recess parts 3B, 3B formed within the notch 3A of each piston 3 and a front surface 2A and rear surface 2B of the swash plate 2. The shoe 4 is arranged with a hemispherical surface 4A which latches to the recess part 3B of the piston 3, and a flat end surface 4B which slides with the front surface 2A or rear surface 2B which are sliding surfaces of the swash plate 2. The shoe 4 is comprised from SUJ2, tempered to the hemispherical surface 4A and end surface 4B and subsequently finish processed. When the swash plate 2 rotates by the rotation of the rotary shaft 1, the hemispherical surface 4A of a pair of shoes 4 and the recess parts 3B, 3B of the piston 3 slide together with the sliding of the front surface 2A of rear surface 2B which are sliding surfaces of the swash plate 2 and the end surface 4B of a pair of shoes 4, thereby each piston 3 is adapted for reciprocated motion along the axial direction of the rotary shaft 1. In addition, when the rotary shaft 1 and the swash plate 2 rotate, lubricating oil is supplied from the inner peripheral part of the swash plate 2 through which the rotary shaft 1 passes through, and the lubricating oil is supplied to the front surface 2A and rear surface 2B which are sliding surfaces together with the rotation of the swash plate 2.

Figure 2:
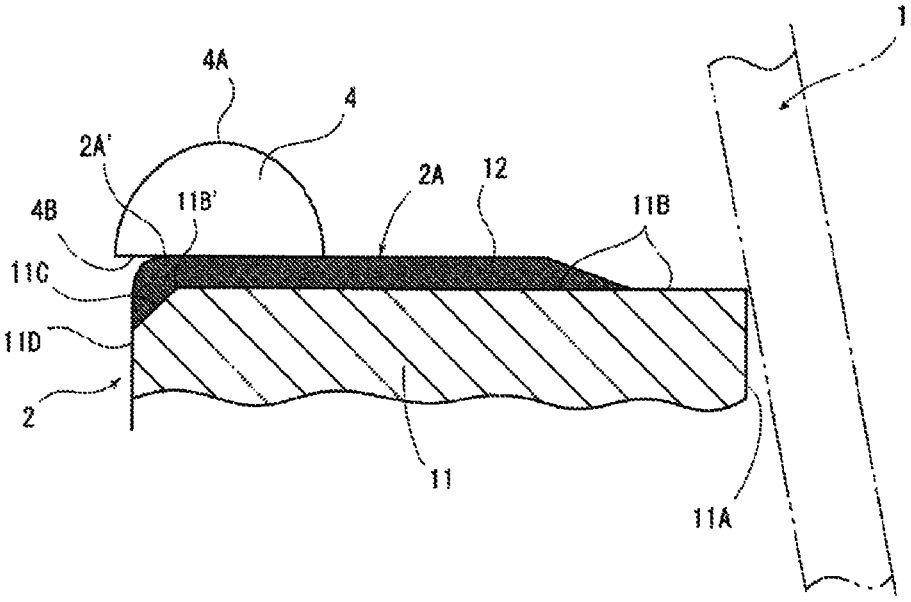
FIG. 2 is a cross-sectional view showing the main parts of the swash plate shown in FIG. 1.
Figure 3:
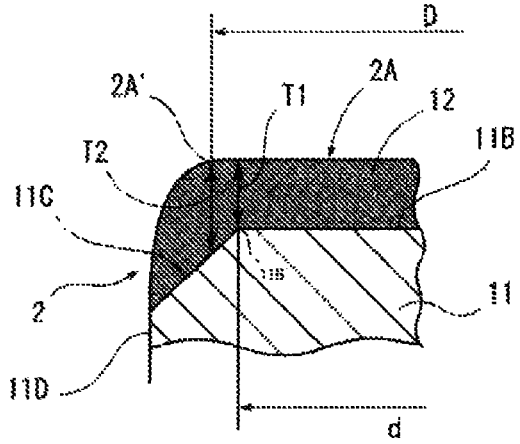
FIG. 3 is an enlarged view of the main parts in FIG. 2.
Figure 4:
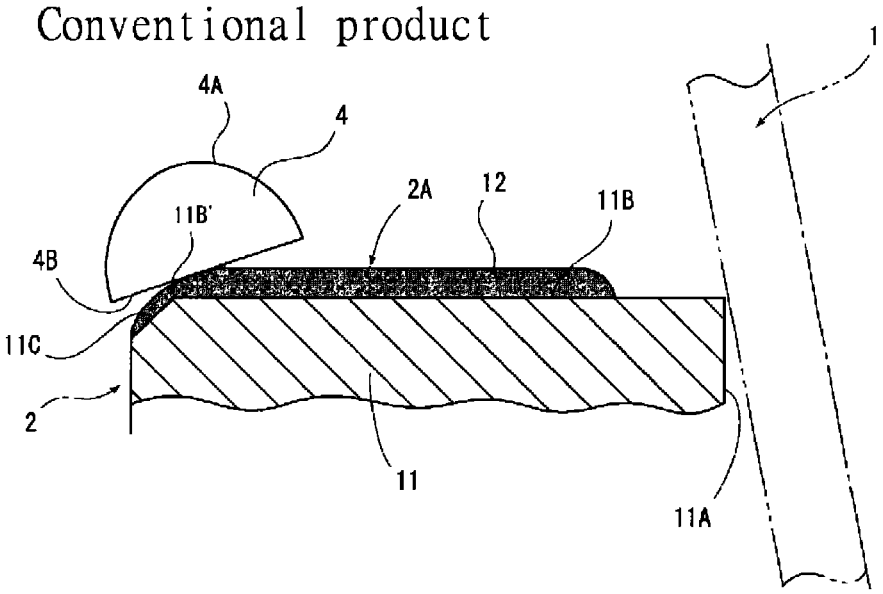
FIG. 4 is a cross-sectional view showing the main parts of a conventional swash plate.
Figure 5:
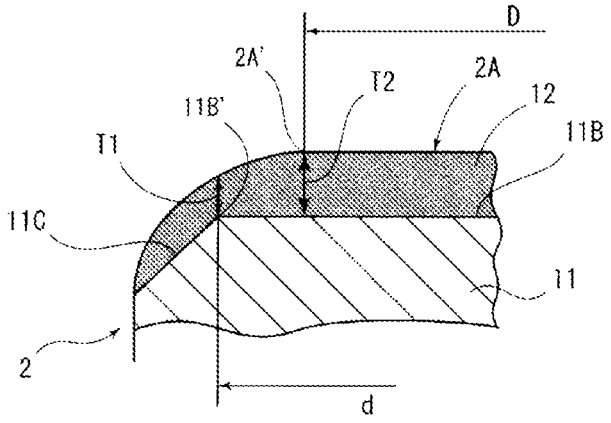
FIG. 5 is an enlarged view of the main parts in FIG. 4.

As is shown in FIG. 2 and FIG. 3, the swash plate 2 is formed from a disc-shaped substrate 11 drilled with a through-hole 11A at the center through which the rotary shaft 1 passes, and a resin film layer 12 which covers both outer parts 11B of the substrate 11. Furthermore, FIG. 2 and FIG. 3 show the outer part 11B which serves as the front surface 2A side of the swash plate 2, and the resin film layer 12 which is applied thereto and the back surface 2B is omitted. The substrate 11 is comprised from an iron-based material and is set to the same thickness throughout. The through-hole 11A of the substrate 11 serves as an inner peripheral part of the swash plate 2. In addition, the outer peripheral part of the outer part 11B of the substrate 11 serves as the chamfered part 11C which is chamfered at 45°. The resin film layer 12 is arranged in an area excluding a part of the inner peripheral part side of the outer part 11B of the substrate 11, and is arranged beyond the outer peripheral edge 11B' which serves as a boundary with the chamfered part 11C to also cover also the chamfered part 11C. In other words, the area of the outer peripheral surface 11D (outer peripheral part of the swash plate 2) of the substrate 11 and the inner peripheral part side of the outer part 11B are in an exposed state.

Then, in the present embodiment, assuming the swash plate 2 includes the structure described above, the thickness of the resin film layer 12 in the chamfered part 11C is set thicker than the thickness of the resin film layer 12 in other areas, thereby, wear of the outer peripheral edge 11B' of the outer part 11B and the resin film layer 12 in that vicinity is suppressed. More particularly, as is shown in FIG. 2 and FIG. 3, when the outer diameter of the outer peripheral edge 2A' of the flat surface of the resin film layer 12 which serves as a sliding surface (surface 2A) which slides with the shoe 4 is given as D, and the outer diameter of the outer peripheral edge 11B' of the outer part 11B of the substrate 11 is given as d, then D>d. In addition, the thickness T2 of the resin film layer 12 of the chamfered part 11C which serves as the outer peripheral edge 2A' is formed to a thickness of the outer peripheral edge 11B' of the outer part 11B and of about 1.5 to 2 times compared to the thickness T1 of the resin film layer 12 in an inner radial direction area. In other words, T2>T1. Specifically, the thickness T2 of the resin film layer 12 in the outer peripheral edge 2A' described above is set to in the 4~100 μm, while the thickness of the outer peripheral edge 11B' of the outer part 11B and the thickness T1 of the resin film layer 12 in sections more to the inner side are set to 2~50 μm. In this way, most of the chamfered part 11C, the outer peripheral edge 11B' of the end face 11B and the front surface of the resin film layer 12 in the region serving more to the radial direction inner side become coplanar and this forms a sliding surface (surface 2A) which slides with the shoe 4.

As a method for covering the outer part 11B of the substrate 11 described above using the resin film layer 12, it is possible to use the following method. That is, it is possible to employ spray coating, roll coating and stamp coating. Furthermore, more preferably, it is preferable to form the resin film layer 12 by spin coating. In the case of spin coating, first a resin coating is coated on both outer parts 11B of the substrate 11 by roll coating, following this, the substrate 11 is held in a rotation machine and rotated at an appropriate rotation speed for a desired period of time. In this way, the resin coating flows to the outer peripheral side from the inner peripheral side of the outer part 11B of the substrate 11 by centrifugal force, and it is possible to form the resin film layer 12 including the structure described above.

The swash plate 2 of the present embodiment is structured as described above. In the swash plate 2 of the present embodiment, as is shown in FIG. 2, the rotary shaft 1 and the swash plate 2 rotate, and the shoe 4 is located above the resin film layer 12 at the position of the outer peripheral edge 11B' of the swash plate 2 side when the piston 3 is at the top dead center or bottom dead center. At this time, because a thick chamfered part 11C is present, it is possible to prevent the shoe 4 from tilting. In other words, the outer peripheral edge 2A', which is an outer peripheral edge of a sliding surface, of the flat surface of the resin film layer 12 is located in a more radially outward direction than the outer peripheral edge 11B' of the outer part 11B. In addition, the thickness T2 of the resin film layer 12 on the outer peripheral edge 2A' is thicker than the thickness T1 of the resin film layer 12 in the outer peripheral edge 11B' of the outer part 11B. As a result, as is shown in FIG. 2, even if the resin film layer 12 at the outer peripheral edge 11B' is pressed strongly by the end surface 4B of the shoe 4, it is possible to prevent the resin film layer 12 at this position from wear. As a result, it is possible to prevent the outer peripheral edge 11B' at the outer part 11B of the substrate 11 and that vicinity from being exposed, and it is possible to prevent these sections and rom sliding directly with the shoe 4. Therefore, according to the present embodiment, it is possible to provide the swash plate 2 which can prevent seizure.

INDUSTRIAL APPLICABILITY

The present invention is a swash plate of a swash plate type compressor and can be used as a swash plate arranged with a resin film layer serving as a sliding surface.

The invention claimed is:

1. A swash plate comprising:

a substrate formed in a disk shape and with a chamfered part on an outer peripheral edge of an end surface; and a resin film layer arranged to cover an end surface of the substrate and formed beyond an outer peripheral edge of an end surface serving as the chamfered part to cover up to the chamfered part, a flat surface of the resin film layer serving as a sliding surface sliding with a shoe;

wherein the resin film layer in the chamfered part is thicker than the chamfered part and thicker than the resin film layer in a radial inner direction side, the outer peripheral edge of the flat surface of the resin film layer serving as a sliding surface is located above the chamfered part serving as a radial outer direction than an outer peripheral edge of the end surface of the substrate, and when a thickness of the resin film layer at the outer peripheral edge of the flat surface of the resin film layer is given as T2 and a thickness of the resin film layer at the outer peripheral edge on the end surface of the substrate is given as T1, the thickness T2 is set larger than the thickness T1.

2. The swash plate according to claim 1, wherein a surface of the resin film layer at the chamfered part and a surface of the resin film layer at the outer peripheral edge of the end surface become coplanar, and a surface of the resin film layer at the chamfered part becomes the sliding surface.

3. The swash plate according to claim 1 or claim 2, wherein the thickness T2 is set to 4~100 μm, and the thickness T1 is set to 2~50 μm.

* * * * *